United States Patent [19]

Satomi et al.

[11] 4,272,180

[45] Jun. 9, 1981

[54] ELECTROSTATIC COPYING MACHINE

[75] Inventors: Toyokazu Satomi; Yutaka Koizumi; Isao Nakamura; Yasuhiro Tabata; Tamaki Kaneko, all of Tokyo, Japan

[73] Assignee: Ricon Co., Ltd., Tokyo, Japan

[21] Appl. No.: 42,058

[22] Filed: May 24, 1979

Related U.S. Application Data

[62] Division of Ser. No. 884,137, Mar. 7, 1978, Pat. No. 4,187,024.

[30] Foreign Application Priority Data

Mar. 9, 1977 [JP] Japan ..... 52-25769
Apr. 6, 1977 [JP] Japan ..... 52-39190

[51] Int. Cl.[3] ..... G03G 15/00

[52] U.S. Cl. ..... 355/3 SH; 271/3.1; 271/9; 355/14 SH; 355/24

[58] Field of Search ..... 355/3 R, 3 SH, 3 TR, 355/14 R, 14 SH, 24; 271/3.1, 4, 9

[56] References Cited

U.S. PATENT DOCUMENTS

| | | | |
|---|---|---|---|
| 3,980,406 | 9/1976 | Lang | 355/24 |
| 4,050,805 | 9/1977 | Hage | 355/14 SH |
| 4,110,032 | 8/1978 | Hubbard et al. | 355/14 SH X |
| 4,129,377 | 12/1978 | Miyamoto et al. | 355/14 SH |

*Primary Examiner*—Fred L. Braun
*Attorney, Agent, or Firm*—David G. Alexander

[57] ABSTRACT

First and second original documents are copied on the opposite sides of a copy sheet in superposition in such a manner that the centers of the two copied images on the opposite sides of the copy sheet are coincident with each other. The two copied images are offset from the center of the copy sheet, leaving a blank area at one edge of the copy sheet for binding a number of copy sheets together in book form. The present copying machine is further provided with two sheet cassettes containing copy sheets of different sizes, a device for selecting the desired copy sheet size and intermediate sheet holder for temporarily holding the selected copy sheet between the copy operations of the first and second original documents.

3 Claims, 17 Drawing Figures

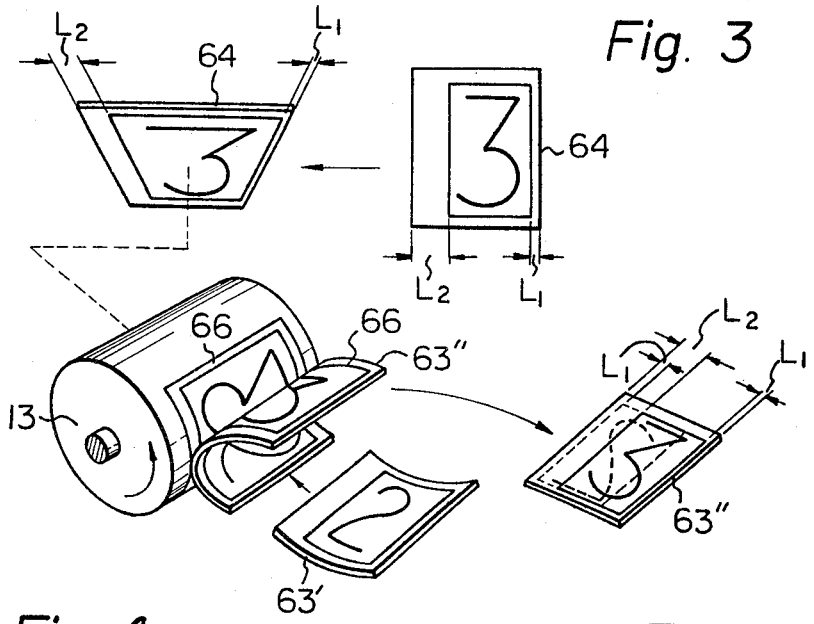
Fig. 3
Fig. 4
PRIOR ART
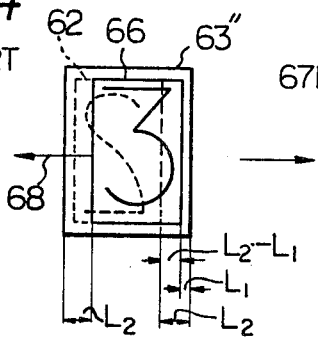
Fig. 5
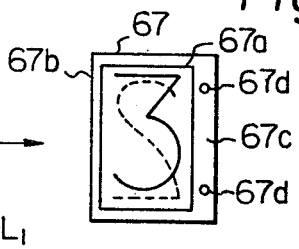
Fig. 6
PRIOR ART
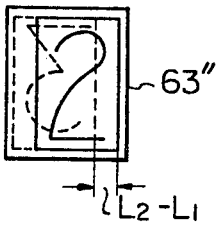
Fig. 7
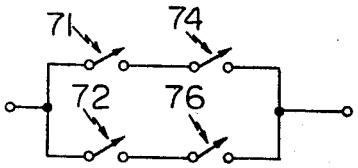

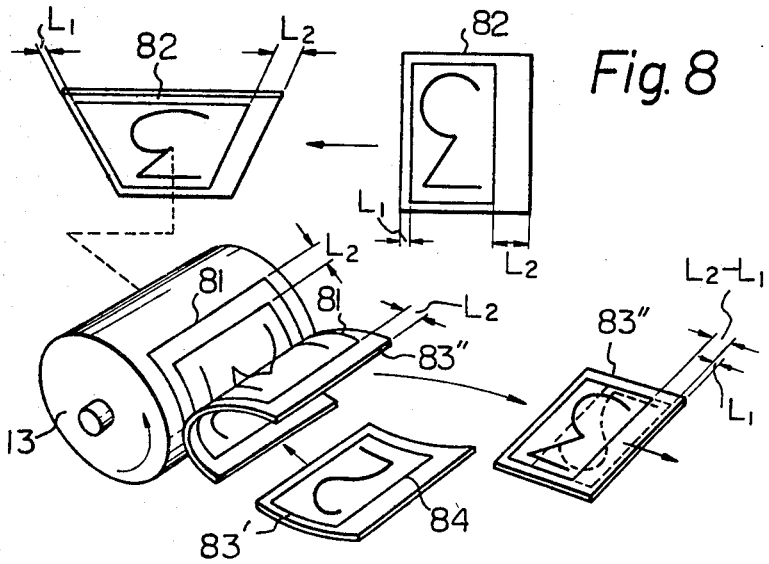
Fig. 8
Fig. 9
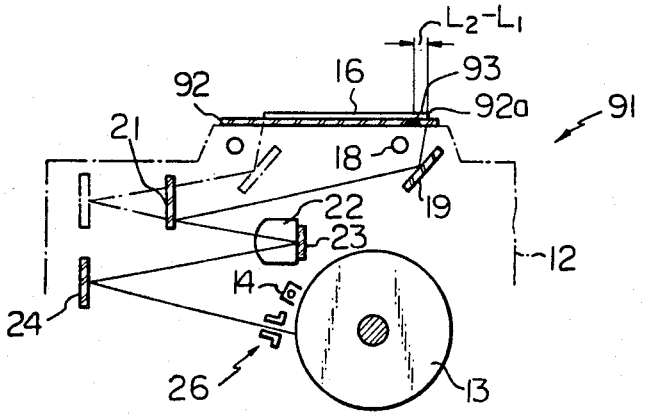

ELECTROSTATIC COPYING MACHINE

CROSS REFERENCE TO RELATED APPLICATION

This application is a division of copending U.S. Patent Application Ser. No. 884,137, filed Mar. 7, 1978, now U.S. Pat. No. 4,187,024, issued Feb. 5, 1980.

BACKGROUND OF THE INVENTION

The present invention relates to an improved electrostatic copying machine for copying two original documents on the opposite sides of a copy sheet in superposition in such a manner that the centers of the two copies imaged on the opposite sides of the copy sheet are coincident with each other.

Electrostatic copying machines have been proposed heretofore which copy two different original documents on the opposite sides of a copy sheet in such a manner that the two copied images are superposed and centered on the copy sheet. However, it is often desired to copy in such a manner that the centers of the copied images on the opposite sides of the copy sheet are coincident with each other and that the copied images are offset from the center of the copy sheet, leaving a blank space at an edge of the copy sheet which can be used as a binding area for binding a number of copy sheets together in book form. An electrostatic copying machine capable of copying on both sides of a copy sheet and which is further capable of copying in such a manner that the two copied images are thus superposed but offset from the center of the copy sheet has not heretofore been invented.

It is further desirable to provide copy sheets of two different sizes in suitable cassettes in such a manner that the desired size can be selected merely by changing over a switch or lever. Such copy machines are known in the art. However, a copying process on both sides of a copy sheet requires that an intermediate sheet holder be provided to temporarily hold the copy sheet between the first and second copy operations. Where it is desired to change the sheet size, the sheet holders must be readjusted in conjunction with each other to accommodate the new size. This operation is time consuming and relatively difficult, and furthermore increases the chances of a sheet jam and due to improper adjustment. A copying machine which copies on both sides of a copy sheet and which furthermore allows changeover from one copy sheet size to another by a simple switching operation has not been available heretofore.

SUMMARY OF THE INVENTION

It is an object of the present invention to provide an electrostatic copying machine by which first and second original documents may be copied on opposite sides of a copy sheet in superposition in such a manner that the centers of the copied images on the opposite sides of the copy sheet are coincident with each other and that the copied images are offset from a center of the copy sheet by a predetermined amount.

It is another object of the present invention to provide an electrostatic copying machine by which first and second original documents may be copied on opposite sides of a copy sheet and by which copy sheets of different sizes may be selected by a simple switch changeover operation.

It is another object of the present invention to provide a generally improved electrostatic copying machine.

Other objects, together with the foregoing, are attained in the embodiments described in the following description and illustrated in the accompanying drawing.

BRIEF DESCRIPTION OF THE DRAWING

FIGS. 2 and 3 are perspective diagrammatic views of a copying process using the copying machine of FIG. 1 but without the improvements of the present invention;

FIGS. 4 and 5 are diagrams illustrating the principle of the invention;

FIG. 6 is a diagram illustrating a drawback of the prior art;

FIG. 7 is an electrical schematic diagram of a selector switch means of the invention;

FIG. 8 is a perspective diagrammatic view illustrating an electrostatic copying process with image inversion;

FIG. 9 is a schematic side elevation of a second embodiment of the invention;

DESCRIPTION OF THE PREFERRED EMBODIMENTS

While the electrostatic copying machine of the invention is susceptible of numerous physical embodiments, depending upon the environment and requirements of use, substantial numbers of the herein shown and described embodiments have been made, tested and used, and all have performed in an eminently satisfactory manner.

Figure 1:
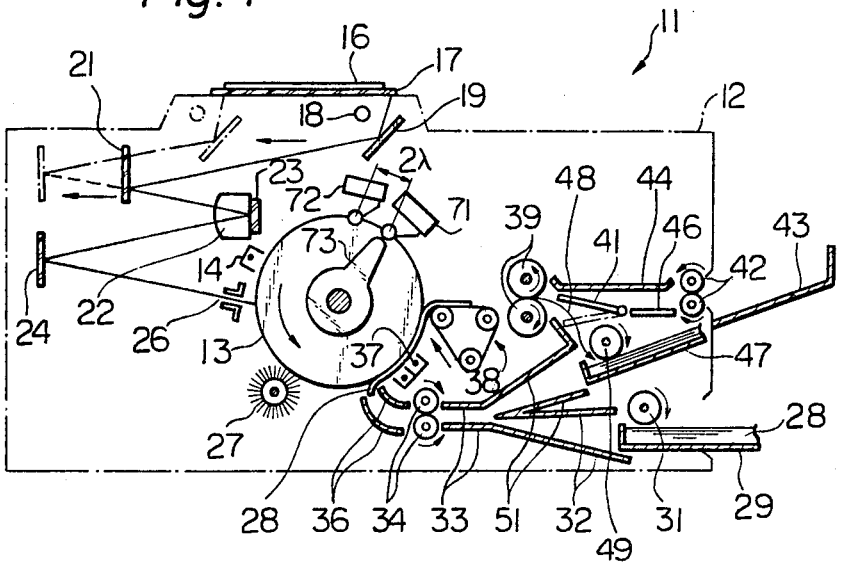
FIG. 1 is a schematic side elevation of an electrostatic copying machine embodying the present invention.

Referring now to FIG. 1 of the drawing, an electrostatic copying machine embodying the present invention is generally designated by the reference numeral 11 and comprises a housing 12 in which is supported a photoconductive drum 13 for counterclockwise rotation at constant speed. A corona charging unit 14 applies a uniform electrostatic charge to the drum 13.

An original document 16 which is to be copied is placed face down on a transparent glass platen 17 and illuminated from below by a lamp 18. A light image of a linear portion of the document 16 above the lamp 18 is reflected from a plane mirror 19 to a plane mirror 21 from which the light image is reflected through a converging lens 22 to a plane mirror 23. The light image is reflected from the mirror 23 back through the lens 22 to a plane mirror 24, from which it is reflected through a slit 26 and focussed onto the drum 13.

The document 16 is scanned by moving the light source 18 and mirror 19 leftwardly at the same surface speed as the drum 13. The mirror 21 is also moved leftwardly but at ½ the surface speed of the drum 13. For scanning, the light source 18 and mirrors 19 and 21 are moved leftwardly from the solid line positions to the phantom line positions. After scanning, the light source 18 and mirrors 19 and 21 are returned to the solid line position in preparation for another scanning operation.

The scanning operation results in an electrostatic image of the document 16 being formed on the drum 13 through localized photoconduction. A magnetic brush developing unit 27 applies a toner substance to the drum which develops the electrostatic image into a toner image.

A stack of copy sheets 28 are provided in a sheet holder or cassette 29. At a proper relative timing, the top copy sheet 28 is fed by a feed roller 31 between guides 32 and 33 into the bite of feed rollers 34 which in turn feed the copy sheet 28 between guides 36 into engagement with the drum 13.

A transfer charger 37 applies an electrostatic charge of the same polarity as the charge on the drum 13 to the back of the copy sheet 28 which causes the toner image to be transferred to the copy sheet 28. A conveyor 38 feeds the copy sheet 28 from the drum 13 into the bite of fixing rollers 39 which fix the toner image to the copy sheet 28 through pressure and/or heat. From the fixing rollers 39 the copy sheet 28 is fed over a guide plate 41 which is held in the lower phantom line position and between guides 44 and 46 into the bite of feed rollers 42 which feed the copy sheet 28 external of the housing 12 into a discharge tray 43 from which the copy sheet 28 may be removed for use.

The above process is used for producing a copy on only one side of the copy sheet 28. However, the copying machine 11 is further capable of copying another original document on the opposite side of the copy sheet 28. In this case, after the first toner image is fixed to the copy sheet 28 by the fixing rollers 39, the guide plate 41 is raised to the upper solid line position so as to deflect the copy sheet 28 onto an intermediate sheet holder 47 as indicated by an arrow 48. An intermediate feed roller 49 is raised to allow the copy sheet 28 to pass thereunder onto the holder 47. Then, the original document 16 is removed from the platen 17 and replaced by another original document (not shown) in the same manner. The second original document is scanned to form a toner image thereof on the drum 13. As the second toner image approaches the transfer charger 37, the feed roller 49 is lowered and rotated clockwise to feed the copy sheet 28 between guides 51, the guides 33, the feed rollers 34 and the guides 36 into engagement with the drum 13 at a predetermined timing relative to the position of the toner image on the drum 13. After transfer of the second toner image, the guide plate 41 is lowered, the second toner image is fixed to the copy sheet 28 and the copy sheet 28 is fed onto the discharge tray 43 in the manner described above.

It will be easily seen that if the above mentioned operation of copying two toner images on the opposite sides of a copy sheet is repeated, a number of the same copies may be produced. In addition, it is to be noted that the copying machine 11 of FIG. 1 is further capable of copying first and second toner images of two original documents on the opposite first and second sides of a number of copy sheets in such a manner that after the first toner image is continuously copied on the first sides of all the copy sheets, the second toner image is continuously copied on the second sides of all the copy sheets.

A careful examination of FIG. 1 will indicate that the first toner image is transferred to one side of the copy sheet 28 whereas the second toner image is transferred to the opposite side thereof. This is because the various feed components in combination with the intermediate sheet holder 47 serve to turn the copy sheet 28 over relative to the drum 13.

For normal copying, the two toner images are superposed and centered on the copy sheet. It will be understood that the two original documents may be printed matter on opposite sides of a sheet of paper rather than two physically different documents. For example, the two original documents may be printed on opposite sides of a page of a book.

Figure 2:
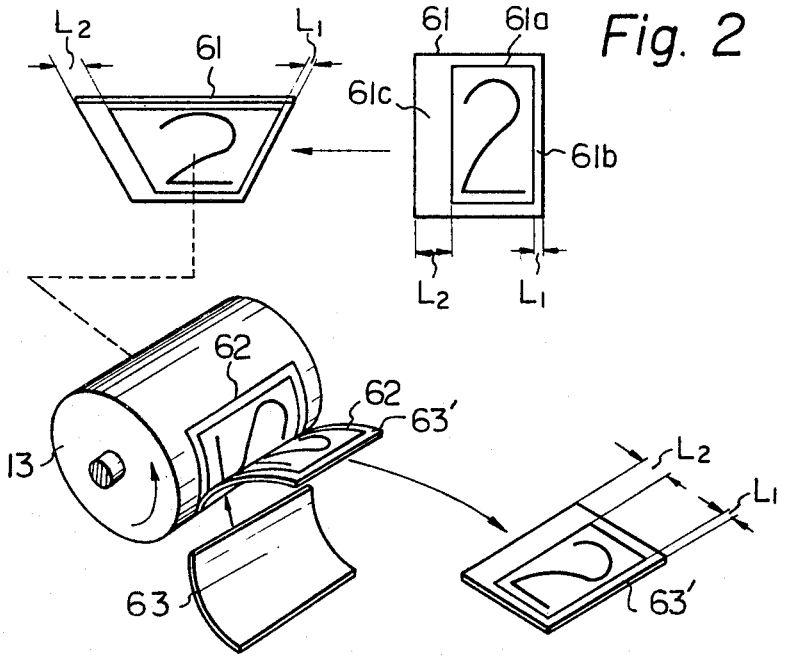

FIG. 2 shows an original document in the form of a page of a book which is designated as 61. The page 61 has a printing or image area **61*a* which is bordered on opposite sides by a margin area 61*b* having a width L1 and a binding area 61*c* having a width L2. The binding area 61*c* is used for binding the page 61 together with other pages to form a book, although not illustrated. It will be noted that the image area 61*a* is offset from the center of the page 61** by a distance $\lambda$ which is equal to $(L2-L1)/2$.

Where the page 61 is arranged on the platen 17 with the margin **61*b* parallel to the drum 13, a toner image 62 is produced by the imaging and development operations. A copy sheet 63 is moved into engagement with the drum 13 and the toner image 62 is transferred thereto. The copy sheet 63 with the toner image 62 transferred thereto is designated as 63' and appears exactly the same as the page 61. After the fixing operation, the copy sheet 63' is temporarily fed onto the intermediate sheet holder 47** as described above.

FIG. 3 illustrates another page 64 having the same format as the page 61 being scanned to produce a toner image 66 on the drum 13. The copy sheet 63' is fed into engagement with the drum 13 and the toner image 66 transferred to the opposite side thereof. The copy sheet 63' with the toner image 66 transferred thereto is designated as 63''. As seen in FIGS. 3 and 6, the image areas on the opposite sides of the copy sheet 63'' are offset from each other by a distance equal to $2\lambda$ or L2-L1. This is undesirable where the copy sheet 63'' is to be bound in book form since the binding areas on the opposite sides thereof are not superposed.

FIGS. 4 and 5 illustrate what is required to produce a copy 67 illustrated in FIG. 5 having superposed image, margin and binding areas designated as **67*a*, 67*b* and 67*c* respectively. As indicated by an arrow 68 in FIG. 4, it is necessary to displace the toner image 66 leftwardly by a distance equal to $2\lambda = L2-L1$ relative to the toner image 62**.

This may be accomplished in the copying machine 11 by mans of microswitches 71 and 72 which are spaced apart from each other in the direction of movement of the drum 13, in this case, the circumferential direction, by the distance $2\lambda$. The microswitches 71 and 72 are normally open and are closed by an actuator cam 73 integrally attached to the drum 13. The microswitches 71 and 72 are illustrated in FIG. 7.

Further illustrated in FIG. 7 are selector switches 74 and 76 connected in series with the switches 71 and 72 respectively. The series combination of the switches 71 and 74 is connected in parallel with the series combination of the switches 72 and 76. The entire combination of switches 71, 72, 74 and 76 is connected to a drive mechanism for the feed roller 49, although not illustrated. The switches 74 and 76 are changed over by a switch mechanism (not shown) which the operator sets to indicate whether or not the offset operation illustrated in FIGS. 4 and 5 is to be performed.

Where two original documents are to be copied on the opposite sides of a copy sheet, the first imaging and transfer operations are performed in the same manner regardless of whether the offset operation of FIGS. 4 and 5 is to be performed. In other words, the copy sheet is moved into engagement with the drum 13 for transfer of the first toner image thereto at the same relative timing or position relative to the first toner image, and the copy sheet with the first toner image transferred thereto is temporarily stored on the intermediate sheet holder 47.

Where two original documents having centered image areas or the opposite sides of a page having the format of the copy sheet 67 of FIG. 5 are to be copied on the opposite sides of a copy sheet, the switch 76 is closed. The feed roller 49 is driven to initiate feeding of the copy sheet from the intermediate sheet holder 47 to the drum 13 when the microswitch 72 is closed by the cam 73, thus completing the series circuit through the switches 72 and 76. The placement of the microswitch 72 is such that the copy sheet is moved into engagement with the drum 13 for transfer of the second toner image at the same relative timing or position as for the first toner image.

When it is desired to copy documents having the formats of the documents 61 and 64 on the opposite sides of the copy sheet and produce a copy having the format of the copy sheet 67 of FIG. 5, the switch 74 is closed. The copy sheet is fed from the intermediate sheet holder 49 into engagement with the drum 13 at a relative timing advanced by (L2-L1)/3 when the microswitch 71 is closed by the actuator cam 73. The parameter S is the surface speed of the drum 13 which is also equal to the feed speed of the copy sheet.

As the result of this operation, the copy sheet mates with the second toner image on the drum 13 at a positional acvance of L2-L1 relative to the first toner image. This accomplishes the desired shift or offset of L2-L1 illustrated in FIGS. 4 and 5. It will be noted that the superposed image area of the copy sheet 67 is offset from the center of the copy sheet 67 by the distance λ as the result of the shift of 2λ. It will be further understood that the switches 74 and 76 serve to enable the switches 71 and 72 respectively. Further illustrated in FIG. 5 are holes **67*d* punched through the binding area 67*c* of the copy sheet 67 to facilitate binding the copy sheet 67** together with other copy sheets of the same format in book form.

The present invention may also be adapted to copy original documents which do not have offset image areas onto the opposite sides of a copy sheet in such a manner that the copy will appear as in FIG. 5. This is accomplished by adapting the exposure optical system so as to reduce the light image of the documents from the size of the copy sheet 67 to the size of the image area **67*a*, where the original documents are the same size as the copy sheet 67. For documents of other sizes, the optical system is adapted to produce light images of the documents which are the same size as the image area 67*a*** through enlargement or reduction depending on the size of the original documents.

In this case the microswitches 71 and 72 are shifted counterclockwise or clockwise as desired by the distance λ from the positions described above, shifting the first toner image by the distance λ toward the trailing or leading edge respectively of the copy sheet and superposing the second toner image on the first toner image. As a result, both toner images are offset from the center of the copy sheet by the distance λ.

The present invention may also be adapted to produce, in the format shown in FIG. 5, copies of documents having image areas which are offset from the center by various distances. In this case, the microswitches 71 and 72 are adapted to be integrally movable about the circumference of the drum 13 to a position determined by the operator upon observation of the amount of offset of the image area. The same arrangement may be used to produce copies having centered image areas from original documents having offset image areas. This latter arrangement is also applicable for copying on only one side of a copy sheet.

FIG. 8 shows the operation of transferring a second toner image 81 of an original document 82 onto a copy sheet 83' to which a first toner image 84 has been transferred as the result of a first transfer operation. The copy sheet 83' after transfer of the toner image 81 thereto is designated as 83''. It will be noted that the original document 82 is inverted with respect to the original document 64 shown in FIG. 3. In this case, the functions of the microswitches 71 and 72 are reversed so as to produce a positional lag of L2-L1, rather than an advance, of the second toner image 81 relative to the first toner image 84 in the copying process. The result is identical to FIG. 5, and will not be illustrated repetitiously.

Figure 10:
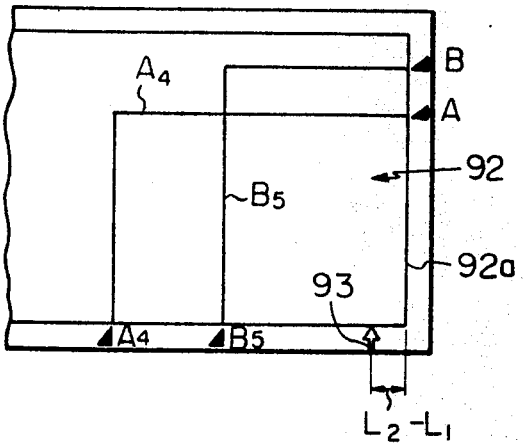
FIG. 10 is a diagram illustrating the principle of the embodiment of FIG. 9.

FIGS. 9 and 10 illustrate another embodiment of the present invention in which like elements are designated by the same reference numerals. In a copying machine 91, the microswitches 71 and 72 and cam 73 are omitted, and the copy sheets are fed from the intermediate sheet holder 47 at the same relative timing regardless of whether the offset operation is desired. The platen is here designated as 92 since it is adapted to be provided with a mark 93. The first original document is placed with the right edge thereof (not designated) aligned with the right edge of the platen 92, as indicated at **92*a*. The second original document has the right edge thereof aligned with the mark 93, which is spaced from the right edge 92*a*** by the distance L2-L1. This arrangement results in the images being superposed on the copy sheet but offset from the center thereof by the distance λ.

Figure 11:
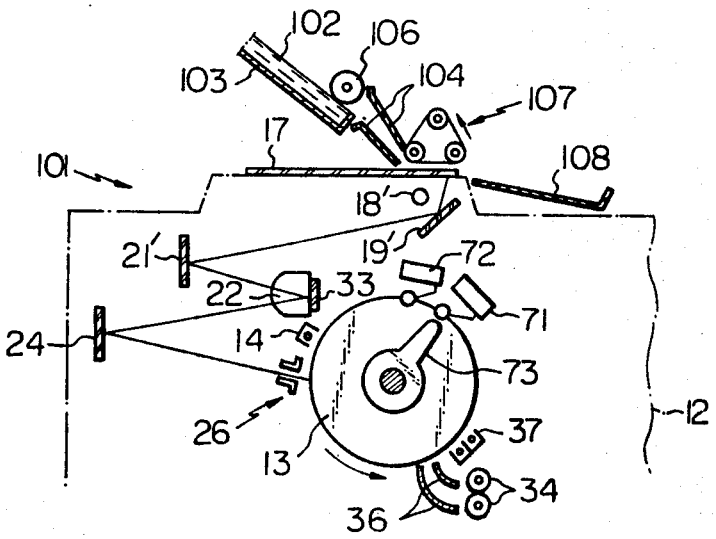
FIG. 11 is a schematic side elevation of a third embodiment of the present invention.

FIG. 11 shows another copying machine 101 comprising optical elements which are stationary rather than movable and are designated by the same reference numerals primed. Original documents 102 are stacked in a tray 103 for high speed copying and are fed one by one between guides 104 by a feed roller 106 over the right portion of the platen 17. A conveyor 107 moves the documents 102 over the platen 17 at the same surface speed as the drum 13 and discharges the documents 102 into a discharge tray 108. In this case, the microswitches 71 and 72 control the relative timing at which the documents 102 are fed from the tray 103. The copy sheets are always fed at the same relative timing. A selector switch means (not shown) alternately enables the microswitches 71 and 72 so that the document to be copied on the second side of a copy sheet is delayed by L2-L1 relative to the feed initiation of the first document. In other words, feed of the first and second documents is initiated by the microswitches 71 and 72 respectively. The result is the same as illustrated in FIG. 5.

Figure 13:
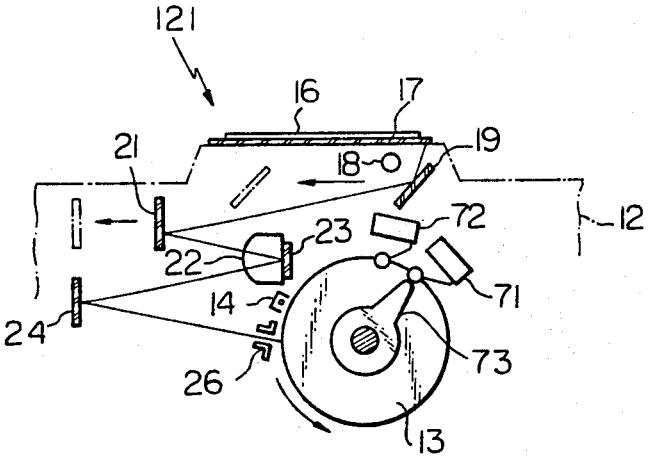
FIG. 13 is a schematic side elevation of a fifth embodiment of the present invention.

FIG. 13 shows another copying machine 121 in which the microswitches 71 and 72 are adapted to control the relative timing at which the mirrors 19 and 21 and lamp 18 begin their leftward scanning movement. In this case also, the copy sheets are fed at the same relative timing in the copy cycle. The scanning operations for the first and second documents are initiated by the microswitches 71 and 72 respectively, producing a lag of L2-L1 for the second scanning operation relative to the first scanning operation.

Further illustrated in FIG. 10 are original documents of Japanese standard sizes B5 and A4. The B5 documents are processed by the embodiments described hereinabove since they are elongated parallel to the drum 13 and the corresponding toner images are also elongated parallel to the drum 13. The offset of the toner images is perpendicular to the axis of the drum 13, or parallel to the direction of movement of the copy sheets when the copy sheets are moved in engagement with the drum 13 for toner image transfer.

The A4 documents are, however, elongated perpendicular to the axis of the drum 13 and the desired offset is perpendicular to the direction of movement of the copy sheets. For this reason, the embodiments described hereinabove will not provide the desired offset.

Figure 14:
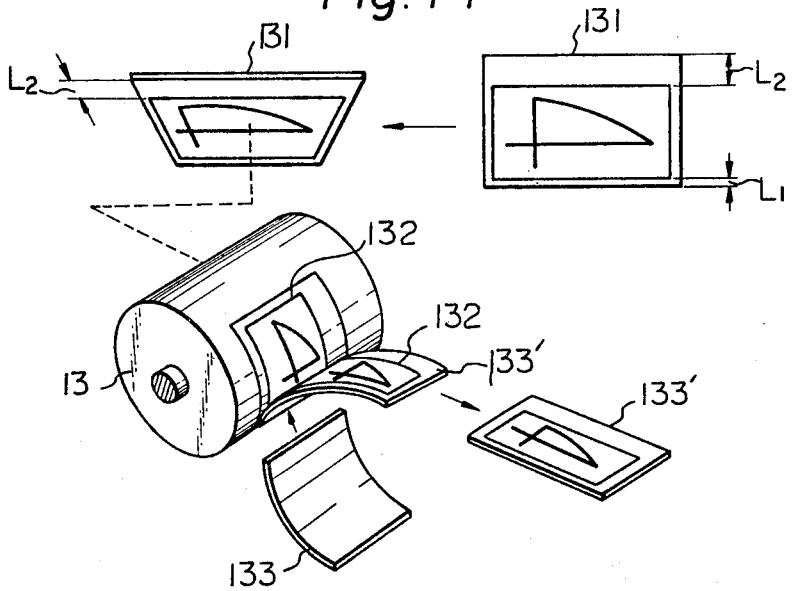
FIGS. 14 and 15 are perspective diagrammatic views illustrating a modification of the embodiment of FIG. 1.
Figure 15:
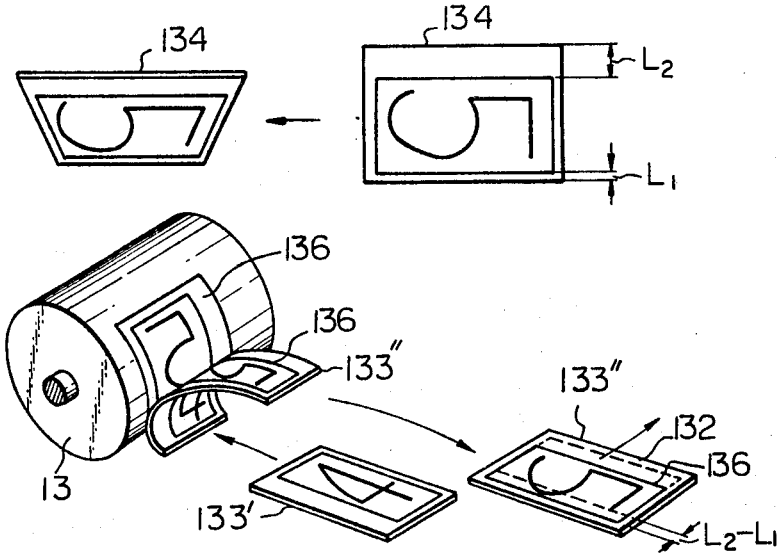

As illustrated in FIG. 14, an original document 131 is scanned to produce a toner image 132 on the drum 13 which is transferred to a copy sheet 133, designated as 133' after the first toner image transfer. As shown in FIG. 15, a second original document 134 is imaged to produce a toner image 136 which is transferred to the other side of the copy sheet 133', designated as 133" after transfer of the second toner image 136. The second toner image 136 must be displaced perpendicular to the direction of movement of the copy sheet 133" by the distance L2-L1 to be superposed on the toner image 132.

This may be accomplished by varying the positions of the documents on the platen 17 in a manner analogous to FIG. 9. Alternatively, the intermediate sheet holder 47 may be shifted laterally to provide the desired offset.

Figure 12:
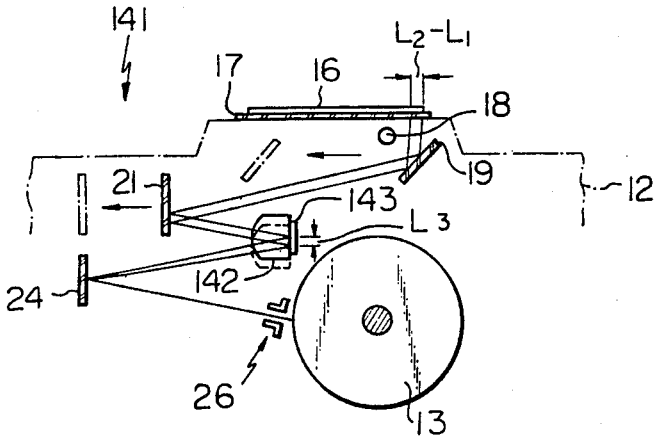
FIG. 12 is a schematic side elevation of a fourth embodiment of the present invention.

FIG. 12 illustrates another copying machine comprising means for obtaining the desired offset parallel or perpendicular to the direction of movement of the copy sheets as required. In this case, an integral converging lens 142 and mirror 143 are adapted to be movable between solid and phantom line positions which are separated by a distance L3. As illustrated, the lens 142 and mirror 143 are movable vertically to provide an offset in the direction parallel to the direction of movement of the copy sheets on the drum 13. In other words, the lens 142 and mirror 143 are moved perpendicular to the axis of the drum 13. The displacement L3 is selected to correspond to an offset of L2-L1 at the platen 17. The same principle may be applied to obtain an offset required to correct the condition illustrated in FIGS. 14 and 15 by moving the lens 142 and mirror 143 parallel to the axis of the drum 13 by the distance L3.

It will be noted that the present invention may also be practiced in an electrostatic copying machine in which the photoconductive member is a moving plate or belt and the exposure is accomplished with a single flash rather than by scanning. Any of the means described hereinabove which serve to vary the relative position of the toner image on the photoconductive member and the copy sheet when fed into engagement therewith may be utilized to provide the desired offset.

Figure 16:
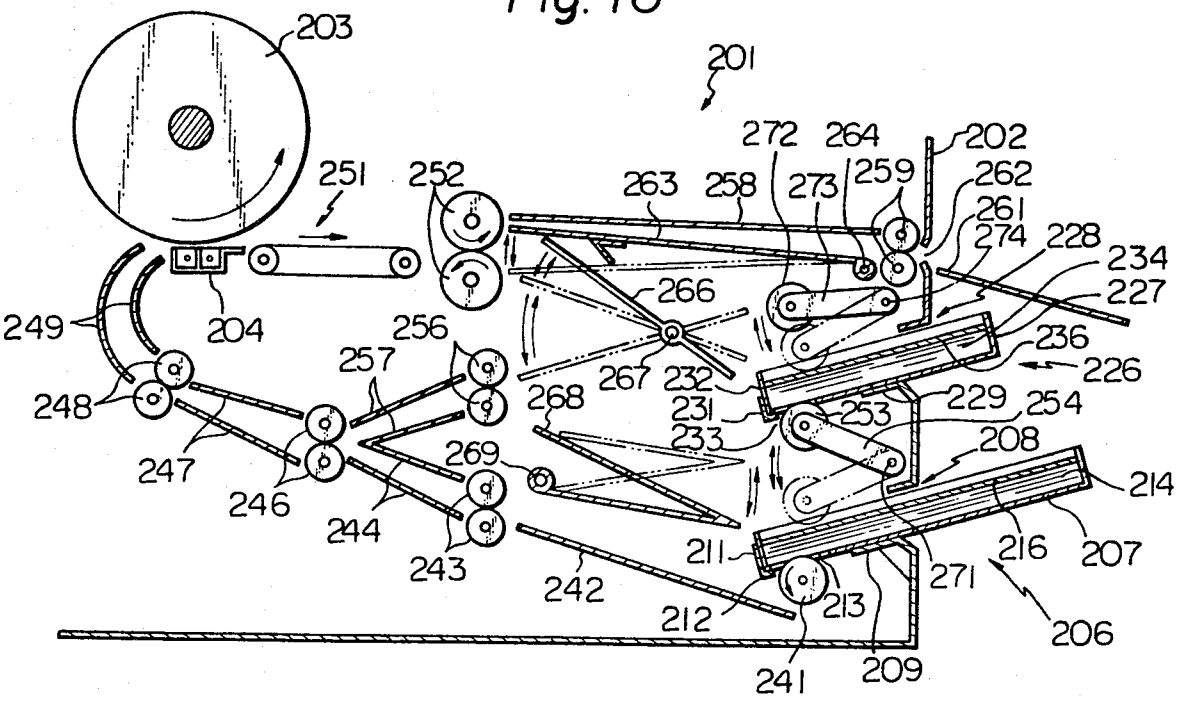
FIG. 16 is a schematic side elevation of the embodiment of FIG. 1 adapted to accommodate two different sizes of copy sheets.
Figure 17:
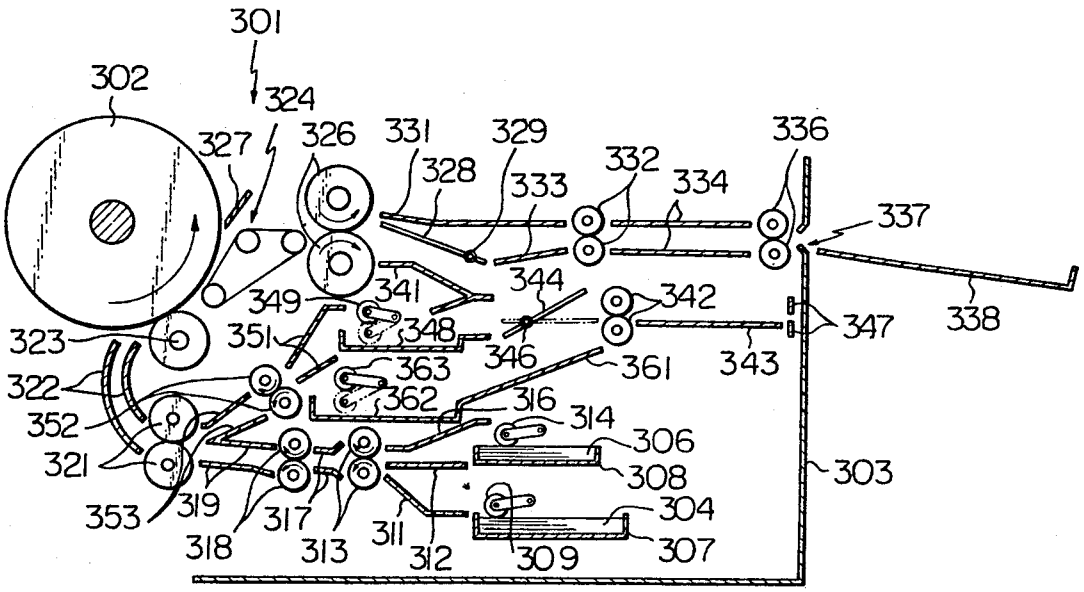
FIG. 17 is a schematic side elevation of the embodiment of FIG. 1 adapted by different means to accommodate two different sizes of copy sheets.

As mentioned hereinabove, it is desirable to be able to produce copies on several different sizes of copy sheets by means of a simple switch changeover operation, for example Japanese standard B5 and A4 sizes. FIGS. 16 and 17 illustrate means for accomplishing this function which may be incorporated into any of the electrostatic copying machines described hereinabove, providing the capability of copying on both sides of the copy sheets of either selected size.

FIG. 16 illustrates an electrostatic copying machine 201 which comprises a housing 202 and a rotary photoconductive drum 203 which is rotated at constant speed in the counterclockwise direction. Further illustrated is a transfer charger 204 analogous to the transfer charger 37.

A sheet cassette 206 comprising a sheet holder or open box 207 is detachably mounted to the housing 202 through a hole 208. The box 207 is supported by a bracket 209 fixed to the housing 202. A stationary bracket 211 engages the left or front portion of the box 207 to aid in the support thereof. The left or front wall of the box 207 is cut away as indicated at 212. In addition, a hole 213 is formed through the bottom wall of the box 207. Copy sheets 214 of, for example, size A4 are provided in stack form in the box 207. A plate 216 which bifunctions as an intermediate sheet holder is placed on top of the sheets 214 in the box 207, pressing the sheets 214 against the bottom of the box 207.

In an essentially similar manner, a sheet cassette 226 comprising a sheet holder or open box 227 is detachably mounted to the housing 202 through a hole 228. The box 227 is supported by a bracket 229 fixed to the housing 202. A stationary bracket 231 engages the left portion of the box 227 to aid in the support thereof. The left wall of the box 227 is cut away as indicated at 232. A hole 233 is formed through the bottom of the box 227. Copy sheets 234 of, for example, size B5 are provided in the box 227 in the form of a stack. A plate 236 which provides the same functions as the plate 216 is placed on top of the sheets 234 in the box 227.

A feed roller 241 intrudes into the box 207 to feed the lowermost sheet 214 from the box 207 through the open wall 212 onto a guide plate 242 which guides the copy sheet 214 into the bite of feed rollers 243. The feed rollers 243 feed the copy sheet 214 between guides 244 into the bite of feed rollers 246 which feed the copy sheet 214 between guides 247 into the bite of feed rollers 248. The feed rollers 248 feed the copy sheet 214 into engagement with the drum 203 through guides 249 for toner image transfer by means of the transfer charger 204. A conveyor 251 feeds the copy sheet 214 into the bite of fixing rollers 252.

In an essentially similar manner, a feed roller 253 mounted on an arm 254 is operative to feed the lowermost copy sheet 234 from the box 227 through the open wall 232 into the bite of feed rollers 256. The feed rollers 256 feed the copy sheet 234 between guides 257 into the bite of the feed rollers 246 for movement into engagement with the drum 203 in the manner described hereinabove.

Further illustrated are a fixed guide plate 258 and discharge rollers 259 arranged to feed the copy out of the housing 202 through a hole 262 onto a discharge tray 261. An upper guide plate 263 is fixed at its right edge to a rotary shaft 264 and movable thereby between an upper solid line position and a lower phantom line position. An intermediate guide plate 266 is fixed at a central portion thereof to a rotary shaft 267 and movable thereby between an upper solid line position and intermediate and lower phantom line positions.

A lower guide plate 268 formed in an acute angular shape is fixed at the lower left edge thereof to a rotary shaft 269 and movable thereby between a lower solid line position and an upper phantom line position.

The arm 254 is fixed at its right end to a rotary shaft 271 and movable thereby between an upper solid line position and a lower phantom line position. Further illustrated is a feed roller 272 supported by an arm 273 which is fixed to a rotary shaft 274 and movable thereby between an upper solid line position and a lower phantom line position.

The copying machine 201 operates as follows:

Copying on one side of A4 sheet

In this operation a copy of a single original document (not shown) is to be made on one side of the lowermost copy sheet 214 of Japanese standard size A4 which is initially provided in the cassette 206. A toner image of the document is formed on the drum 203 in the manner described hereinabove. At the proper relative timing in the copy cycle, the feed roller 241 is rotated to feed the lowermost copy sheet 214 into toner image transferring engagement with the drum 203 with the assistance of the feed rollers 243, 246 and 248. The toner image is fixed to the copy sheet 214 by the fixing rollers 252.

In this case, the upper guide plate 263 is moved to its lower phantom line position, the intermediate guide plate 266 is moved to its intermediate or lower phantom line position and the lower guide plate 268 is moved to its lower solid line position. The lower guide plate 268, in this position, aids in guiding the copy sheet 214 from the box 207 to the feed rollers 243.

With the upper guide plate 263 in the lower position, the fixing rollers 252 feed the copy sheet 214 over the upper guide plate 263 to the discharge rollers 259 which discharge the finished copy onto the discharge tray 261.

Whereas the position of the feed roller 272 is irrelevant in this case, the feed roller 253 is moved to its upper solid position out of engagement with the cassette 206.

Copying on one side of B5 sheet

The copying operation of copying a single original document on one side of a B5 sheet initially provided in the cassette 226 is quite similar to the operation for the A4 sheet. The upper guide plate 263 is moved to its lower position. The intermediate guide plate 266 is moved to its lower phantom line position and the lower guide plate 268 is moved to its upper position. The feed roller 272 is moved to its upper position out of engagement with the cassette 226. The feed roller 253 is moved to its upper position.

At the proper timing in the copy cycle, the feed roller 253 is rotated to feed the lowermost copy sheet 234 out of the box 227 into the bite of the feed rollers 256 for movement to the drum 203. In this case, the guide plates 266 and 268 serve to guide the copy sheet 234 therebetween to the feed rollers 256. From the fixing rollers 252, the copy sheet 234 is fed over the guide plate 263 to the discharge rollers 259 for discharge into the discharge tray 261 in the same manner as for the A4 sheet.

Copying on both sides of A4 sheet

The operation of copying the first original document on the first side of the lowermost copy sheet 214 is similar to the operation described above until the copy sheet 214 leaves the fixing rollers 252. In this case, however, the upper guide plate 263 is moved to the upper position and the intermediate guide plate 266 is also moved to the upper position. The lower guide plate 268 is moved to the lower position as in the single copying operation.

The copy sheet 214, after the first transfer operation, is fed from the fixing rollers 252 between the guide plates 266 and 268 onto the plate 216, which serves as an intermediate or temporary sheet holder. Then, the guide plates 263, 266 and 268 are moved to the lower, intermediate or lower and upper positions respectively.

At the proper relative timing, the feed roller 253 is lowered into engagement with the copy sheet 214 on the plate 216 and driven to feed the same out of the box 207 through the open wall 212 into the bite of the feed rollers 243. The guide plate 268 in the upper position serves to guide the copy sheet 214 from the plate 216 to the feed rollers 243 in conjunction with the guide plate 242. The second toner image is transferred and fixed to the opposite side of the copy sheet 214 and the copy sheet 214 is fed out of the housing 202 over the upper guide plate 263 which is in the lower position.

Careful examination of FIG. 16, after a reading of the above description, will readily disclose that the copy sheet 214 is, in effect, turned over by the various feed elements in combination with the plate 216, so that the first and second toner images are copied on the opposite respective sides of the copy sheet 214.

Copying on both sides of B5 sheet

This operation is similar to the corresponding A4 operation except that the cassette 226 is utilized. The guide plates 263, 266 and 268 are initially moved to the upper, lower and upper positions respectively. The feed roller 253 is moved to the upper position and driven to feed the lowermost copy sheet 234 out of the box 227 into the bite of the feed rollers 256 which feed the same to the drum 203 for the first toner image transfer. The guide plates 266 and 268 guide the copy sheet 234 therebetween to the feed rollers 256.

After the copy sheet 234 is feedingly gripped by the feed rollers 256, the guide plate 266 is moved to the intermediate position. The copy sheet 234 is fed from the fixing rollers 252 between the guide plates 263 and 266 onto the plate 236. It will be noted that the feed roller 272 must be in the upper position to allow the copy sheet 234 to be fed onto the plate 236.

Prior to the second toner transfer the upper and lower guide plates 263 and 266 are both moved to the lower respective positions. At the proper relative timing in the copy cycle, the feed roller 272 is lowered and driven to feed the copy sheet 234 from the plate 236 between the guide plates 266 and 268 into the bite of the feed rollers 256. After the second toner transfer, the copy sheet 234 is fed over the upper guide plate 263 into the discharge tray 261. It will be understood that the copy sheet 234 is turned over relative to the drum 203 so that the first and second toner images are transferred to the opposite respective sides of the copy sheet 234.

As mentioned hereinabove, any of the means for producing a desired offset between the toner images may be applied to the apparatus of FIG. 16.

Whereas in FIG. 16 the initial and intermediate sheet holders are provided in unitary form as cassettes, the initial and intermediate sheet holders may be separate as shown in FIG. 17. In an electrostatic copying machine 301, a photoconductive drum 302 is rotated counter-clockwise inside a housing 303. Copy sheets of Japanese standard A4 and B5 sizes are designated as 304 and 306 and are provided in cassettes 307 and 308 respectively which have the form of open boxes. A feed roller 309 is arranged to feed the uppermost copy sheet 304 from the cassette 307 between guides 311 and 312 into the bite of feed rollers 313. Alternatively, a feed roller 314 may be driven to feed the uppermost copy sheet 306 between the guide 312 and a guide 316 into the bite of the feed rollers 313. The feed rollers 313 feed the selected copy sheet 304 or 306 between guides 317 into the bite of feed rollers 318 which feed the selected copy sheet between guides 319 into the bite of feed rollers 321. The feed rollers 321 feed the selected copy sheet between guides 322 into engagement with the drum 302 for toner image transfer by means of a biased transfer roller 323. A bias voltage of the same polarity as the electrostatic charge on the drum 302 is applied to the transfer roller 323 to urge the toner image onto the copy sheet. A conveyor 324 moves the copy sheet into the bite of fixing rollers 326. A separating pawl 327 ensures that the copy sheet will separate from the drum 203.

Copying on one side of sheet

To copy a single original document on one side of a copy sheet, the feed roller 304 or 306 for the selected copy sheet size A4 or B5 respectively is driven at the proper relative timing to feed the selected copy sheet into toner image transferring engagement with the drum 302 via the feed rollers 313, 318 and 321 as described above. A guide plate 328 is fixed at its right edge to a rotary shaft 329 and movable thereby between an upper solid line position and a lower phantom line position. For a single copying operation, the guide plate 328 is moved to its lower position and the copy sheet is fed from the fixing rollers 326 between the guide plate 328 and a guide plate 331 into the bite of feed rollers 332. The copy sheet further passes between the guide plate 331 and a guide plate 333. The feed rollers 332 feed the copy sheet between guides 334 to discharge rollers 336 which feed the copy sheet out of the housing 303 through a hole 337 onto a discharge tray 338.

Copying on both sides of A4 sheet

The first transfer operation is performed in the same manner as for copying on only one side of the sheet 304 except that the guide plate 328 is moved to its upper position. After fixing of the first toner image to the copy sheet 304, the copy sheet 304 is deflected between the guide plate 328 and a guide plate 341 into the bite of feed rollers 342 which feed the copy sheet 304 onto a switchback sheet holder 343. A guide plate 344 is fixed to a rotary shaft 346 and movable thereby between an upper solid line position and a lower phantom line position. The guide plate 344 is moved to the lower position to allow the copy sheet 304 to pass thereover to the switchback sheet holder 343. A sensor means 347 provided near the right end of the switchback sheet holder 343 such as a photoelectric transmitter-receiver unit is actuated by the leading edge (right edge) of the copy sheet 304 and causes the feed rollers 342 to reverse their direction of rotation. The guide plate 344 is maintained in the lower position, allowing the feed rollers 342 to feed the copy sheet 304 thereover into an intermediae sheet holder or tray 348. A feed roller 349 is held in an upper position, allowing the copy sheet 304 to pass thereunder onto the sheet holder 348.

After formation of the second toner image on the drum 302 and at the proper relative timing in the copying cycle, the feed roller 349 is lowered into engagement with the copy sheet 304 and driven to feed the copy sheet 304 out of the sheet holder 348 between guides 351 into the bite of feed rollers 352 which in turn feed the copy sheet 304 between guides 353 into the bite of the feed rollers 321.

The feed rollers 321 feed the copy sheet 304 into engagement with the drum 302 to transfer the second toner image to the opposite side thereof. It will be noted that the various feed components, in combination with the sheet holders 343 and 348 serve to turn over the copy sheet 304 relative to the drum 302 so that the first and second toner images are transferred to the opposite respective sides of the copy sheet 304. Prior to entry of the copy sheet 304 into the bite of the fixing rollers 326 for the second time, the guide plate 328 is moved to its lower position, allowing the fixing rollers 326 to feed the copy sheet 304 to the feed rollers 332 for discharge into the discharge tray 328.

Copying on both sides of B5 sheet

For copying the first original document on the first side of the uppermost B5 sheet 306, the feed roller 314 is driven to feed the copy sheet 306 into toner image transferring engagement with the drum 302. The copy sheet 306 is fed onto the switchback sheet holder 343 in the same manner as for the A4 sheet 304 described hereinabove. However, after the leading edge of the copy sheet 306 is sensed by the sensor means 347, the guide plate 344 is moved to its upper position. Thus, when the feed rollers 342 are reversed, the copy sheet 306 is fed between the guide plate 344 and a guide 361 onto an intermediate sheet holder 362. After formation of the second toner image on the drum 302, a feed roller 363 is lowered and driven to feed the copy sheet 306 into the bite of the feed rollers 352 for movement into engagement with the drum 302 for transfer of the second toner image. Prior to the copy sheet 306 entering the bite of the fixing rollers 326, the guide plate 328 is lowered allowing the copy sheet 306 to be discharged into the tray 338. Naturally, the sheet holders or cassettes 307 and 308 are sized for the respective copy sheets 304 and 306 as are the intermediate sheet holders 348 and 362.

From the foregoing, it will be easily seen that if the above mentioned operation of copying the first and second toner images on the opposite sides of the A4 or B5 copy sheet in both the copying machines 201 and 301 is repeated, a number of the same copies may be produced. In addition, it is to be noted that both the copying machines 201 and 301 are further capable of copying the first and second toner images on the opposite first and second sides of a number of copy sheets in such a manner that after the first toner image is continuously copied on the first sides of all the copy sheets, the second toner image is continuously copied on the second sides of all the copy sheets in a controlled manner.

Where it is desired to copy on a third size of copy sheets, it is merely necessary to replace the cassette 307 and intermediate sheet holder 362 with corresponding units of proper size. In both of the embodiments of FIGS. 16 and 17, the desired coppy sheet size may be selected by means of a simple operator controlled changeover switch or lever, although not shown.

In summary, it will be seen that the present invention overcomes the limitations of the prior art and provides an electrostatic copying machine which is capable of copying first and second original documents on the opposite sides of a single copy sheet in superposition in such a manner that the centers of the copied images on the opposite sides of the copy sheet are coincident with each other. The present copying machine is further capable of offsetting the copied images from the center of the copy sheet to thereby provide a blank area at one edge of the copy sheet by which the copy sheet may be bound together with other copy sheets in book form. In addition, the present machine is capable of copying on either of two selected sizes of copy sheets in a simple and convenient manner.

Various modifications will become possible for those skilled in the art after receiving the teachings of the present disclosure without departing from the scope thereof.

What is claimed is:

1. In an electrostatic copying machine having a moving photoconductive member and means for forming first and second toner images of first and second original documents respectively on the photoconductive member, the combination comprising:

first and second sheet holders for initially holding first and second copy sheets of first and second sizes respectively, the first and second sizes being different;

first and second intermediate sheet holders for temporarily holding the first and second copy sheets respectively;

selector means for selecting one of the first and second copy sheets; and feed means for feeding said selected copy sheet from the respective sheet holder into engagement with the photoconductive member to transfer the first toner image onto a first side of said selected copy sheet, feeding said selected copy sheet onto the respective intermediate sheet holder and subsequently feeding said selected copy sheet from the respective intermediate sheet holder into engagement with the photoconductive member to transfer the second toner image onto a second side of said selected copy sheet.

2. In an electrostatic copying machine having a moving photoconductive member and means for forming first and second toner images of first and second original documents respectively on the photoconductive member, the combination comprising:

first and second sheet holders for initially holding first and second copy sheets of first and second sizes respectively, the first and second sizes being different;

first and second intermediate sheet holders for temporarily holding the first and second copy sheets respectively;

selector means for selecting one of the first and second copy sheets; and feed means for feeding said selected copy sheet from the respective sheet holder into engagement with the photoconductive member to transfer the first toner image onto a first side of said selected copy sheet, feeding said selected copy sheet onto the respective intermediate sheet holder and subsequently feeding said selected copy sheet from the respective intermediate sheet holder into engagement with the photoconductive member to transfer the second toner image onto a second side of said selected copy sheet;

the first sheet holder and the first intermediate sheet holder being unitary and the second sheet holder and the second intermediate sheet holder being unitary;

each of the unitary first and second sheet holders and intermediate sheet holders comprising an open box for holding the respective copy sheet, the box being formed with an open wall facing the photoconductive member and a hole through a bottom wall of the box, the feed means comprising a drive roller for engaging said selected copy sheet through the hole and feeding said selected copy sheet from the box toward the photoconductive member through the open wall, each of the integral first and second sheet holders further comprising a plate retained in the box above the respective copy sheet, the feed means comprising an intermediate drive roller for feeding said selected copy sheet from the plate toward the photoconductive member, the respective sheet holder being constituted by the box and the respective intermediate sheet holder being constituted by the plate.

3. In an electrostatic copying machine having a moving photoconductive member and means for forming first and second toner images of first and second original documents respectively on the photoconductive member, the combination comprising:

first and second sheet holders for initially holding first and second copy sheets of first and second sizes respectively, the first and second sizes being different;

first and second intermediate sheet holders for temporarily holding the first and second copy sheets respectively;

selector means for selecting one of the first and second copy sheets;

feed means for feeding said selected copy sheet from the respective sheet holder into engagement with the photoconductive member to transfer the first toner image onto a first side of said selected copy sheet, feeding said selected copy sheet onto the respective intermediate sheet holder and subsequently feeding said selected copy sheet from the respective intermediate sheet holder into engagement with the photoconductive member to transfer the second toner image onto a second side of said selected copy sheet; and a switchback sheet holder, the feed means feeding said selected copy sheet onto the switchback sheet holder from the photoconductive member after transfer of the first toner image to said selected copy sheet and feeding said selected copy sheet from the switchback sheet holder to the respective intermediate sheet holder.

* * * * *

UNITED STATES PATENT AND TRADEMARK OFFICE

CERTIFICATE OF CORRECTION

PATENT NO. : 4,272,180

DATED : June 9, 1981

INVENTOR(S) : Toyokazu Satomi et al

It is certified that error appears in the above—identified patent and that said Letters Patent is hereby corrected as shown below:

On the title page, the name of the assignee should read --Ricoh Co., Ltd.--.

Signed and Sealed this

*Twenty-ninth* Day of *September 1981*

[SEAL]

*Attest:*

GERALD J. MOSSINGHOFF

*Attesting Officer*

*Commissioner of Patents and Trademarks*